United States Patent [19]

Jensen

[11] 3,946,879

[45] Mar. 30, 1976

[54] DEVICE FOR CROSSWISE LAYING OF RECTANGULAR BUNDLES OF PAPER, OR THE LIKE

[75] Inventor: Fredrik Jensen, Malaga, Spain

[73] Assignee: Lindaco Ltd., Geneva, Switzerland

[22] Filed: Aug. 21, 1974

[21] Appl. No.: 499,160

[30] Foreign Application Priority Data

Sept. 26, 1973 Sweden ..... 7313140

[52] U.S. Cl. ..... 214/6 N; 198/235; 198/282; 214/6 D; 214/152; 271/185; 271/210

[51] Int. Cl.[2] ..... B65G 57/22

[58] Field of Search ..... 214/6 D, 6 N, 6 P, 6.5, 214/152; 198/235, 282, 284; 271/185, 210; 93/93 R; 270/58

[56] References Cited

UNITED STATES PATENTS

| | | | |
|---|---|---|---|
| 1,565,840 | 12/1925 | Wise | 214/6 D |
| 2,637,450 | 5/1953 | Eshelman | 214/6 DK X |
| 2,769,558 | 11/1956 | Ehlers | 198/235 X |
| 2,815,846 | 12/1957 | Stevenson | 198/235 |
| 2,815,870 | 12/1957 | Laub | 214/6 H |
| 2,901,249 | 8/1959 | Dexter et al. | 270/58 |
| 2,986,391 | 5/1961 | Walker | 270/58 |
| 3,159,399 | 12/1964 | Davis et al. | 271/210 |
| 3,222,060 | 12/1965 | Svantesson | 271/210 |

*Primary Examiner*—Robert J. Spar
*Assistant Examiner*—L. J. Paperner
*Attorney, Agent, or Firm*—Toren, McGeady and Stanger

[57] ABSTRACT

Bundles of paper, or the like, are conveyed along a horizontal table from which they pass onto a downwardly inclined table arranged at the end of the horizontal table. The bundles slide down this inclined table into the hopper where they are collected. A pin is mounted in the vicinity of the downwardly inclined table for reciprocating movement through an aperture in the table. The pin and aperture are arranged so as to lie a certain distance from the path of travel of the center of gravity of the bundles so that when the pin is translated through the aperture to interrupt the path of every second bundle, it causes the bundle to rotate by 90 degrees and thereby form a crosswise laying of the bundles in the collection hopper. The aperture through which the pin extends can be in the form of a hole, or of a slot through which the pin is rotated.

10 Claims, 5 Drawing Figures

DEVICE FOR CROSSWISE LAYING OF RECTANGULAR BUNDLES OF PAPER, OR THE LIKE

SUMMARY OF THE INVENTION

The present invention pertains to the preparation of papers, or the like, into bundles and then into compendiums, pamphlets, and the like.

In the prior art, the papers, after being gathered into a bundle, were laid partly overlapping in a vibration machine where each bundle became separate from the other and was evened up.

The present invention provides a simple and reliable solution to the problem of gathering and laying the bundles in overlapping relation and of evening each bundle.

According to the present invention, papers stored in feeding hoppers are conveyed along a horizontal roller table by an endless belt and pad attached to the belt and are formed into bundles. After reaching the end of the horizontal table, the bundles drop to a downwardly inclined table where they slide down under the force of gravity to a collecting hopper located directly beneath the downwardly inclined table. The collecting hopper is inclined relative to a horizontal and vertical plane intersecting the top edge of the hopper. A pair of abutments emanate from two mutually perpendicular edges of the hopper to arrest the movement of the bundles and gather them into a stack. A vibration machine is mounted under the bottom face of the collecting hopper and bundles stacked within it so as to even up each bundle in a neat, orderly arrangement.

In order to properly discriminate between each bundle, the present invention provides a reciprocating pin that is translated through an aperture in the downwardly inclined table. The pin, when extended through the aperture, interrupts the path of travel of a bundle such that the bundle is caused to rotate through an angle of 90°. By extending the pin through the aperture so that only every other bundle has its path of travel interrupted and, therefore rotated, a crosswise laying of the bundles in the collecting hopper is achieved. Accordingly the bundles are arranged in a stack where each bundle positioned at right angles to the one on either side of it.

The movement of the pin is controlled by the path of travel of the bundles along the horizontal table. The pin could be controlled by any well-known device such as an electromagnetic switch arranged to be contacted by the pad mounted on the endless belt.

To provide different sized papers or the like, the downwardly inclined table may be mounted for longitudinal and transver movement relative to the horizontal roller table. By adjusting this downwardly inclined table, bundles of different sizes may be collected in the hopper in a crosswise fashion.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE INVENTION

Figure 1:
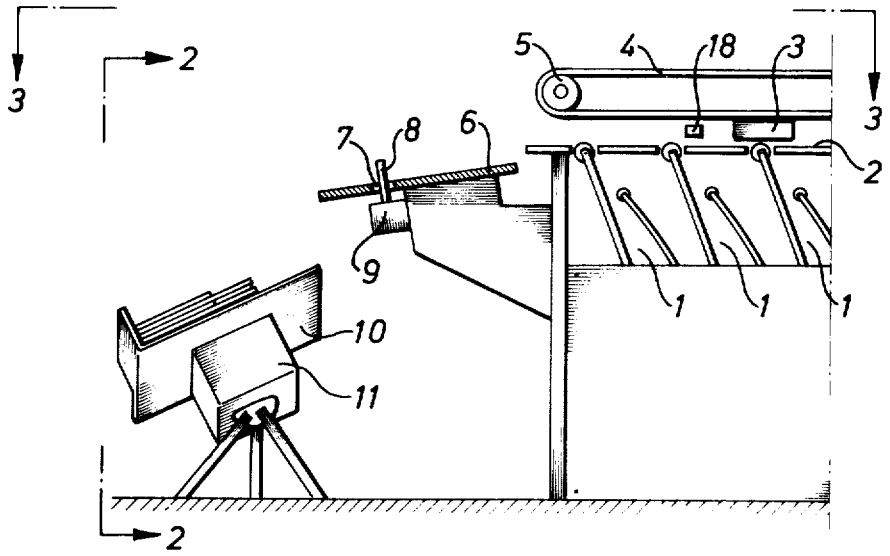
FIG. 1 is a schematic side view of a device according to the present invention.

In FIG. 1, feeding hoppers 1 store the papers, or the like, that are to be formed into bundles. Located above the feeding hoppers 1 is a roller table 2 on which the papers are conveyed and formed into bundles in a conventional manner. The papers are formed into bundles 15 and conveyed along the roller table 2 by a gathering pad 3 attached to an endless belt 4. The endless belt 4 runs over a pulley 5, and may be driven by any conventional means such as an electric motor (not shown). The bundles are transported downstream which is to the left in FIG. 1.

Mounted downstream of the roller table 2 is a downwardly inclined table 6. The upstream end of the table 6 lies adjacent to and somewhat below the downstream end of the roller table 2. When the bundles are conveyed along the roller table 2 and reach the downstream end they drop onto the table 6. Table 6 is inclined so that each bundle 15 slides down it under the force of gravity.

Figure 3A:
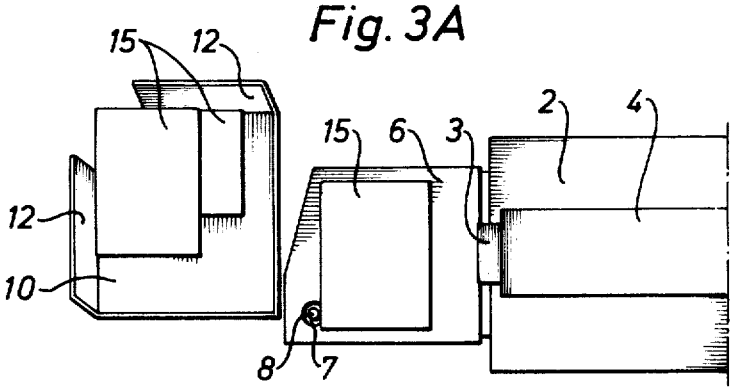
FIG. 3*a* – FIG. 3*c* each afford a top view taken along line III—III in FIG. 1, and show how a typical bundle is rotated through a 90° by the obstructing pin.
Figure 3B:
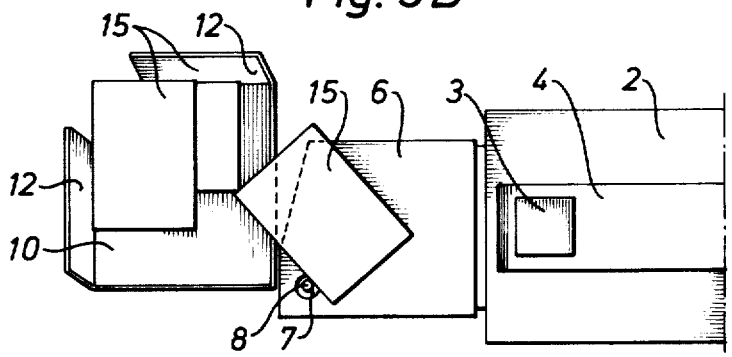
Figure 3C:
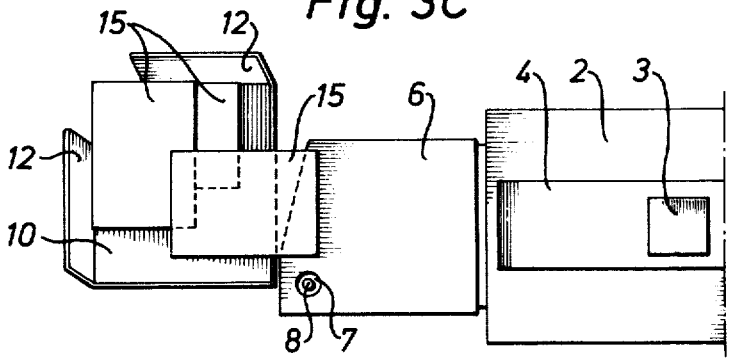

The table 6 has an aperture formed in its downstream half. A pin 8 connected at its lower end to a driving means 9, which may be an electromagnetic motor, or any other conventional power source, is movable in the aperture 7. The driving means 9 is mounted below the table 6 on the side opposite to the path of the bundles 15. Pin 8 is reciprocated in the aperture 7 by driving means 9 such that its top portion is moved from a position where it extends above the plane of table 6 to a position where it is located below the plane. The pin 8, and therefore the aperture 7, is located such that the path of travel of the center of gravity of the bundles 15 is a certain distance from the pin 8 (FIG. 3).

Mounted below the table 6 at its downstream end is a collecting hopper 10. The collecting hopper 10 has an upstream edge 20 located a certain distance below the downstream end of the table 6.

Figure 2:
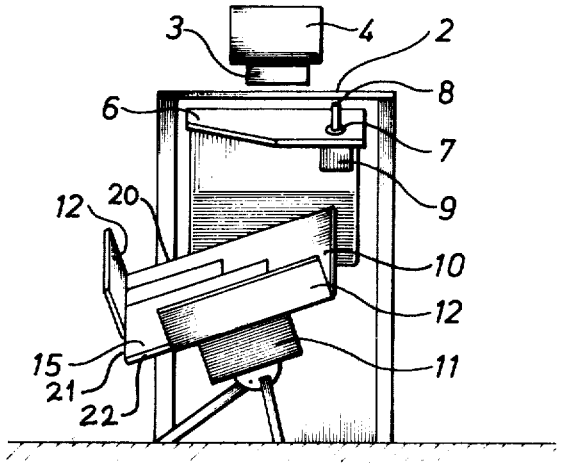
FIG. 2 is a front view taken along line II—II in FIG. 1.

The hopper 10 is inclined relative to a vertical plane extending in a direction perpendicular to the horizontal plane of the table 2, and a horizontal plane parallel with the table 2, both planes intersecting the upstream edge 20. Typically, the angle with respect to the vertical plane is about 20° (FIG. 1) and the angle with respect to the horizontal plane is about 35°. As seen in FIG. 2, the angle with respect to the horizontal plane makes the hopper 10 tilt to the left causing the bundles 15 to descend to the lower left corner of the hopper. Edges 21 and 22, which are perpendicular to each other, mount edgings 12. Each edging 12 extends to near the lower left corner of the hopper 10 but does not reach it. The bundles 15 falling from the table 6 strike the face of the hopper 10 and accumulate in the lower left portion of the hopper as seen in FIG. 2.

Mounted beneath the hopper 10 on the face opposite to the one supporting the bundles 15 is a vibration machine 11 that vibrates the hopper 10 for causing all the papers in the bundles to even up and afford a neat package.

The operation of the device will now be described. The papers stored in the feeding hoppers a are conveyed downstream by the pad 3 and endless belt 4. Upon reaching the downstream end of the roller table 2, the bundles that are formed drop onto the downwardly inclined table 6 where they descend by the force of gravity. The reciprocating pin 8 is extended through the aperture 7 so that every other bundle 15 is rotated by 90 degrees as shown in FIGS. *3a* – *3c*. The driving means 9 which reciprocates the pin 8 is actuated by a microswitch 18 (FIG. 1) controlled by the movement of the pad 3. The switch 18 is connected in series with a power source (not shown) and the driving means 9. After the bundle has travelled the full distance of table 6, it falls into the hopper 10 where it rests in the lower left portion. The fall from the table 6 is facilitated by cutting out the right hand part of the table front as shown in FIGS. *3a* – *3c*. Since every other bundle is rotated by 90°, the bundles are arranged in a crisscross fashion in the hopper for subsequent use.

The table 6 is also made adjustable in the longitudinal directional parallel with the path of transport, and the transverse direction which is perpendicular to the path of transport. This is done to accommodate different sized papers and bundles. For every paper size there is a most suitable distance between the center of gravity of the bundles and the pin 8, and this distance is determined by the linear velocity of the bundles, the friction between the bundles and the table 6, and the inclination of the table 6. Therefore, the displacement in the longitudinal direction is determined by the fact that one must let the bundles 15 go free from the pad before it engages the pin 8. The displacement in the transverse direction is determined by that for every bundle size there should be a certain distance between the path of travel of the center of gravity of the bundle and the pin 8.

In order to simplify an adjustment of the table 6, two edges of the table may be provided with markings corresponding to specific paper sizes. Corresponding markings are arranged, for example, at the frame of the table. Therefore, the present invention may be easily adapted to handle bundles of different standard sizes such as A3, A4, A5, or the like.

Several modifications of the device are possible. The driving means 9 for the pin 8 may be a linear motor having a short stroke length, or a relay rocker whose movement displaces the pin 8 at its end positions. Alternatively, the pin 8 may be arranged radially on the shaft of a step motor where rotation controls the position of the pin. Here, the aperture 7 will be in the form of a slot so that the pin 8 may enter and exit radially. The driving means may also be a cam controlled lever.

Other modifications are possible. For example, the angle of the hopper 10 may be altered about 20° to 25° with respect to the horizontal or vertical planes.

While a specific embodiment of the invention has been shown and described in detail to illustrate the application of the inventive principles, it will be understood that the invention may be embodied otherwise without departing from such principles.

What is claimed is:

1. A method for crosswise stacking of rectangular bundles of paper or the like comprising conveying uniformly the bundles in a horizontal plane and then permitting the bundles to freely slide on a downwardly inclined plane at an angle to the horizontal plane along a substantially straight path, interrupting said path of movement of every other bundle at a point displaced from the path of movement of the center of the gravity of the bundles, gathering all of the bundles in a stack by letting them freely slide over the downstream edge of said inclined plane and drop down onto each other, the first bundle being received on a second plane sloping downwardly partly in the direction of said conveying path and partly in a direction transverse to the last mentioned direction, and arresting the movement of the bundles in said directions, the distance between said point and said path of movement of the center of gravity being chosen to provide a generally 90° rotation of said every other bundle during its unobstructed movement between said interruption and the engagement with said stack.

2. A method as set forth in claim 1 further comprising the step of vibrating said stack during and after the stacking operation in order to bring the bundles into full contact with the arresting means.

3. A device for crosswise stacking of rectangular bundles of paper or the like comprising means for uniformly conveying the bundles along a substantially horizontal path, an inclined table having one upstream end in the vicinity of the ending downstream point of said horizontal path and inclined downwardly from and forming an angle with said means for conveying, an opening formed in said table in an area distant from the path of travel of the center of gravity of the bundles as the bundles freely slide along said inclined table from said means for conveying in a straight continuation of said conveying path, means for interrupting the path of travel of the bundles, reciprocation in said opening, means for reciprocating said means for interrupting the bundles through said opening so that every other bundles is interrupted, means controlled by the movement of the bundles along said horizontal path for activating said means for reciprocating, a gathering hopper below said inclined table, comprising a face plate having a front upstream edge in the vicinity of the downstream end of said table, said hopper being inclined downward and forming an angle with a horizontal plane partly in the direction of said collecting path and partly in a direction transverse to last mentioned direction, said hopper further comprising two abutments, one abutment formed on each of the two lowermost edges of said front plate, said abutments being arranged perpendicular to each other, the distance between said interrupting means and said path of travel of the center of gravity of the bundles being arranged such as to cause said every other bundle to unobstructedly rotate substantially 90° during its movement between said interrupting means and said hopper.

4. The device according to claim 3, wherein said means for interrupting the path of travel comprises a pin extending at a right angle to the table.

5. The device according to claim 4, wherein said means for reciprocating comprises a motor.

6. The device according to claim 5, wherein said means for activating said motor comprises a microswitch, said microswitch located along the path of travel of said means for conveying and to arranged to be controlled thereby.

7. The device according to claim 3, wherein said table is movable longitudinally along the path of transport of the bundles, and transversely perpendicular to the path of transport of the bundles.

8. The device according to claim 3, further comprising vibration means located at one face of said face plate for vibrating said hopper so as to even up the edges of the bundles.

9. The device according to claim 3, wherein said means for conveying comprises an endless conveyor belt movable along said horizontal path, a roller table parallel with and directly beneath said conveyor belt, and a gathering pad attached to said conveyor belt for moving the bundles along said roller table till the bundles fall from the end of said roller table on to said inclined table.

10. The device according to claim 3, wherein said opening in said inclined table is a slot extending transversely across said inclined table, said means for interrupting comprises a pin, and said means for reciprocating comprises a step motor having a shaft, said pin connected to said shaft for reciprocating movement into and out of said slot in a radial direction taken along the axis of the shaft.

* * * * *